United States Patent [19]

Baker

[11] 4,135,549

[45] Jan. 23, 1979

[54] SWIMMING POOL FLUID DISTRIBUTION SYSTEM

[76] Inventor: Robert W. Baker, 31 Sherwood La., Willingboro, N.J. 08046

[21] Appl. No.: 769,906

[22] Filed: Feb. 18, 1976

[51] Int. Cl.[2] ..... F16K 37/00

[52] U.S. Cl. ..... 137/552; 4/172.17; 137/599.1; 137/883; 73/349

[58] Field of Search ..... 137/883, 551-552, 137/884, 599.1; 73/349; 4/172.15, 172.16, 172.17, 191, DIG. 7

[56] References Cited

U.S. PATENT DOCUMENTS

| | | | |
|---|---|---|---|
| 212,758 | 2/1879 | Sprod | 73/349 |
| 1,399,534 | 12/1921 | Witham, Jr. | 73/349 |
| 1,472,265 | 10/1923 | Bell | 137/883 |
| 2,598,961 | 6/1952 | Andrus | 137/883 |
| 2,991,481 | 7/1961 | Book | 137/599.1 |
| 3,400,732 | 9/1968 | Larrabee | 137/883 |
| 3,665,524 | 5/1972 | Jannuzzi, Sr. | 4/172.17 |
| 3,801,992 | 4/1974 | Sable | 4/172.17 |
| 3,928,711 | 12/1975 | Jakobsen | 137/883 |
| 3,949,784 | 4/1976 | Duthion et al. | 137/883 |

*Primary Examiner*—Martin P. Schwadron
*Assistant Examiner*—H. Jay Spiegel
*Attorney, Agent, or Firm*—Duffield & Lehrer

[57] ABSTRACT

A main fluid pipe within a box-like housing has four auxiliary pipes connected thereto. Each auxiliary pipe extends to the outside of the housing. The first auxiliary pipe is connected to the drain of a swimming pool; the second is connected to the swimming pool pump; the third is connected to the skimmer and the fourth which extends upwardly is normally unconnected but closed by a valve. An adapter allows a standard garden hose to be connected to the fourth pipe for priming the pump and the swimming pool skimmer and drain lines. Chemicals may also be introduced into the fluid system through the fourth pipe. A thermometer, visible from the outside of the housing measures the temperature of the water within the pipe connected to the pump. The thermometer also measures the outside air temperature for comparison with the water temperature.

2 Claims, 4 Drawing Figures

*Fig. 2*

SWIMMING POOL FLUID DISTRIBUTION SYSTEM

BACKGROUND OF THE INVENTION

The present invention is directed toward a swimming pool fluid distribution system and more particularly toward a swimming pool fluid distribution system which allows a swimming pool pump, skimmer line and drain line to be quickly and easily primed. The system also allows chemicals, such as powdered chlorine to be easily introduced into the pool and provides a means for indicating the average temperature of the pool water between the top and bottom of the pool, or the temperature at only the bottom or top if desired.

As is known in the art, one of the most difficult and annoying problems of owning a swimming pool is priming the pump, drain and filtering system. Heretofore this has been accomplished by first entering the swimming pool and forcing a garden hose through the drain until the drain line is filled with water. The skimmer line is filled in a similar manner. This procedure is time consuming and annoying.

Other problems are also well known to those owning swimming pools. For example, chemicals such as chlorine must be periodically added to the pool to reduce the bacteria levels in order to keep the pool clean. These chemicals normally come in a powdered or granular form. When they are added to the pool they quite often do not dissolve well and may settle to the bottom thereof wasting substantial amounts of expensive chemicals, and in plastic liner pools, bleaching the color out of the liner where they lay.

A further problem exists with taking the temperature of the water at various levels. Frequently, one or more thermometers may be hung by a rope at the side of the pool so as to be suspended at the proper depth within the pool. When it is desired to read the temperature, the rope is pulled up and the thermometer is removed from the pool. This procedure is not only annoying but it is also dangerous since the glass thermometer can easily be broken; the broken glass adjacent the pool creating an obvious health hazard.

SUMMARY OF THE INVENTION

The present invention overcomes all of the above described problems of the prior art and allows the system to be quickly and conveniently primed. It also makes the addition of chemicals relatively simple and safely and conveniently allows the temperature of the water in the pool to be measured.

The swimming pool fluid distribution system of the present invention includes a main fluid pipe within a box-like housing having four auxiliary pipes connected thereto. Each auxiliary pipe extends to the outside of the housing. The first auxiliary pipe is connected to the drain of a swimming pool; the second is connected to the swimming pool pump; the third is connected to the skimmer and the fourth which extends upwardly is normally unconnected but closed by a valve. An adapter allows a standard garden hose to be connected to the fourth pipe for priming the pump and the swimming pool skimmer and drain lines. Chemicals may also be introduced into the fluid system through the fourth pipe. A thermometer, visible from the outside of the housing measures the temperature of the water within the pipe connected to the pump, and also measures outside air temperature.

BRIEF DESCRIPTION OF THE DRAWINGS

For the purpose of illustrating the present invention, there is shown in the accompanying drawing one form which is presently preferred; it being understood that the invention is not limited to the precise arrangements and instrumentalities shown.

DETAILED DESCRIPTION OF THE PREFERRED EMBODIMENT

Figure 1:
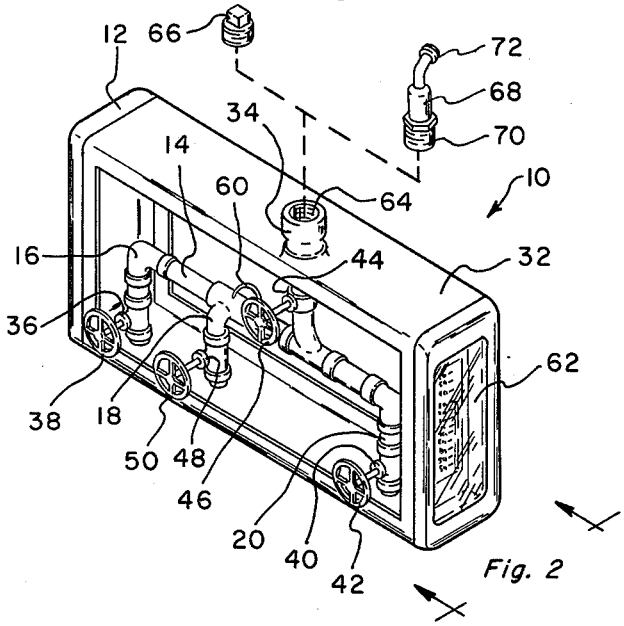
FIG. 1 is a perspective view of a swimming pool fluid distribution system constructed in accordance with the principles of the present invention.

Referring now to the drawings in detail wherein like numerals are used throughout the various figures thereof to indicate similar elements therein, there is shown in FIG. 1 a swimming pool fluid distribution system constructed in accordance with the principles of the present invention and indicated generally at 10. The system 10 includes a substantially hollow box-like housing 12 which contains most of the components thereof. For clarity, the front cover of the housing 12 is not shown in the drawings.

Contained within the housing 12 is a main fluid pipe 14. Main fluid pipe 14 may be comprised of several segments in fluid communication with each other or may be a continuous pipe. Auxiliary pipes 16, 18, 20 and 22 are connected to the main pipe 14 and are in fluid communication therewith. Auxiliary pipes 16, 18 and 20 extend downwardly through the bottom wall 24 of the housing 12 and terminate in pipe or hose fittings 26, 28 and 30, respectively. Auxiliary pipe 22 extends upwardly from the main pipe 14 through the top wall 32 of the housing 12 and has an end 34 on the outside of the housing.

A valve 36 is located in the auxiliary pipe 16 and operates in a conventional manner to allow or prohibit flow of fluid through the pipe. A handle 38 controls the operation of valve 36. Handle 38 is located a slight distance forward of the pipe 16 so as to be accessible from the front and outside of the housing 12 even with the cover (not shown) in position. Similarly, a valve 40 having a handle 42 attached thereto is connected in pipe 20, a valve 44 having a handle 46 is located within pipe 22 and a valve 48 having a handle 50 is located in pipe 18.

Located within the auxiliary pipe 18 is a temperature sensing device 58. Temperature sensing device 58 may be a thermoelectric or similar device. Wires 60 connect the temperature sensing device 58 to a temperature indicator 62 located on the exterior right side wall of the housing 12 so as to be clearly visible from the exterior of the housing.

As shown in FIG. 1, the end 34 of auxiliary pipe 22 has an internally threaded opening 64 which faces upwardly. Opening 64 is preferably of a diameter greater than an inch. A plug 66 having an external complimentary thread thereon is adapted to fit within the opening 64 to close the pipe end 34. In place of plug 66, an adapter 68 may be employed which includes a first end 70 having external threads which are adapted to mate with the interior threads of the opening 64. The other end 72 of adapter 68 includes a conventional hose fitting and is adapted to be connected to a conventional garden hose.

The invention thus described is used in the following manner. The housing 12 of the system 10 is mounted on the wall of a building adjacent the swimming pool or it is otherwise supported in the area adjacent the pool. The hose from the swimming pool skimmer is connected to the pipe end 26 and the hose from the swimming pool drain is similarly connected to the pipe end 30. The swimming pool filter and pump are connected to the pipe end 28.

When it is desired to prime the pump, skimmer line and drain line, adapter 68 is screwed into the opening 64 of pipe end 34. A conventional garden hose is then connected to the adapter end 72. The water pressure is then turned on in the hose and valve 44 is opened. To prime the skimmer line, valve 40 in pipe 20 and valve 48 in pipe 18 are closed and valve 36 in pipe 16 is opened. The water entering pipe 22 is therefore forced through main pipe 14 and auxiliary pipe 16 into the skimmer line and is allowed to flow until the skimmer line is totally filled with water.

After the skimmer line is primed, valve 36 is closed and valve 40 is opened. Water then flows through pipe 22, pipe 14 and pipe 20 to the drain line and continues to flow until the drain line is totally filled with water. At this point, valve 40 is closed and valve 48 is opened to force air out of the pump and filter unit. After the air is forced out of the pump and filter unit, either or both of the valves 36 and 40 are opened and the pump is started. Valve 44 is then closed, the adapter 68 is removed and the plug 66 is inserted into the opening 64 to prevent air from re-entering the system in case valve 44 is ever accidentally opened.

It should be readily apparent that with the pump in operation, water flows from the skimmer through the skimmmer line and through auxiliary pipe 16, main pipe 14 and auxiliary pipe 18. At the same time, water is forced from the drain and drain line through auxiliary pipe 20, main pipe 14 and out auxiliary pipe 18. Thus, water from both the top and bottom of the pool mix within the main pipe 14 and flow as a mixture out auxiliary pipe 18.

Figure 2:
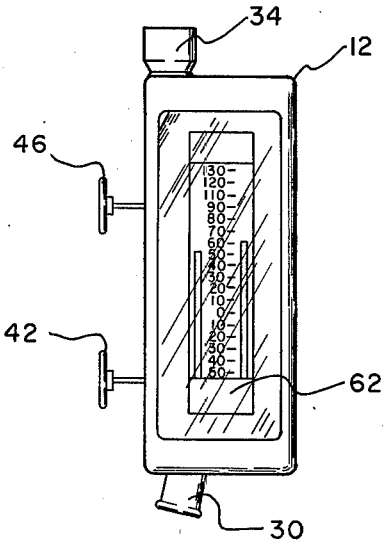
FIG. 2 is a right side elevational view of the system shown in FIG. 1.
Figure 3:
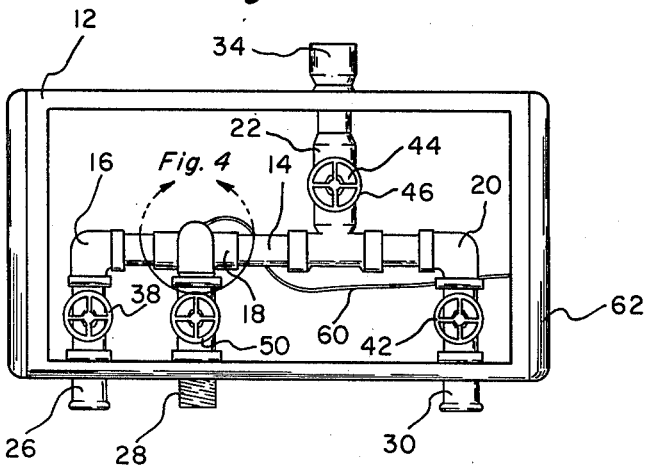
FIG. 3 is a front elevational view.
Figure 4:
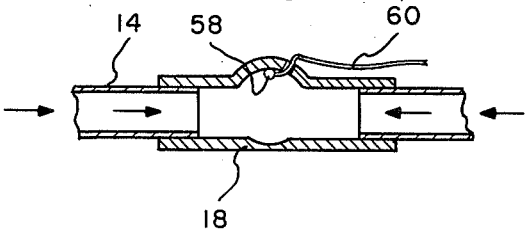
FIG. 4 is an enlarged cross-sectional view of the portion indicated by the arrows in FIG. 3.

The water flowing out of auxiliary pipe 18 is a mixture of the water from the top and bottom of the pool and is, therefore, representative of the average properties of the water throughout the entire depth of the pool. For example, the temperature of the water in pipe 18 is an average of the temperature of the water from the top and bottom of the pool and accordingly, is approximately equal to the water temperature midway down the pool or the average temperature of the water in the pool. This water temperature is sensed by the sensor 58 and is read on the thermometer 62. Thermometer 62 thus displays the average temperature of the water. As shown in FIG. 2, thermometer 62 is actually comprised of two thermometers in one housing. The second thermometer measures the atmospheric temperature.

While the temperature sensing system shown is primarily intended to be used to sense the average temperature of the water in the pool, it can also be used to measure the temperature of the water only at the top of the pool or only at the bottom. This is accomplished by turning off either valve 36 or 40. With valve 40 turned off no water flows from the drain to main pipe 14 and auxiliary pipe 18. Thus, the only water flowing out pipe 18 comes from the skimmer and accordingly, thermometer 62 will display the temperature of the water at the top of the pool only. The temperature of the water at the bottom of the pool can similarly be sensed by closing valve 36 and opening valve 40.

The present invention also makes it easy to add powdered chlorine or other necessary chemicals to the water in the pool. This is accomplished by closing valve 44, removing plug 66 and pouring the desired amount of chemical into the opening 64. Thereafter, plug 66 is replaced and valve 44 opened. The chemicals fall down into main pipe 14 and are drawn through the pipe 14 and out auxiliary pipe 18 to the pump and filter. If the chemicals are in powdered form, they will be forced to dissolve since they will not be able to pass through the filter in their powdered form. Thus, with the use of the present invention, more economical use of the chemicals is made since none of the chemicals will settle to the bottom of the pool undissolved.

The present invention may be embodied in other specific forms without departing from the spirit or essential attributes thereof and, accordingly, reference should be made to the appended claims, rather than to the foregoing specification as indicating the scope of the invention.

I claim:

1. A swimming pool fluid distribution system comprising:

a box shaped housing having a substantially hollow space therein;

a main fluid pipe mounted within the space within said housing;

at least four auxiliary fluid pipes mounted within the space within said housing and being connected to said main fluid pipe, each of said auxiliary pipes having an end which is accessible from the exterior of said housing;

three of said auxiliary pipes having ends accessible from the bottom of said housing, and one of said auxiliary pipes being an inlet pipe having an opening facing upwardly;

each of said auxiliary fluid pipes including a valve therein, each of said valves having a means connected thereto for controlling the operation of the same, said control means being accessible from the exterior of said housing;

temperature sensing means including means for sensing the temperature of the fluid in at least one of said pipes, and means for sensing the temperature of the atmosphere around said housing;

means mounted adjacent an end of said housing for visually displaying the temperatures sensed by said sensing means, and an adaptor means and a plug means, said adaptor means having a first end adapted to be connected to said opening of said inlet pipe and a second end adapted to be connected to a standard garden hose, said plug means also being adapted to be connected to said opening of said inlet pipe for closing the same.

2. A swimming pool fluid distribution system as claimed in claim 1 wherein the ends of said auxiliary pipes extend to the exterior of said housing.

* * * * *